US005727648A

United States Patent [19]

Jenkins, Jr.

[11] Patent Number: 5,727,648

[45] Date of Patent: Mar. 17, 1998

[54] MODULAR LADDER SYSTEM

[76] Inventor: Joseph Robert Jenkins, Jr., 12203 Becontree Dr., Baton Rouge, La. 70810

[21] Appl. No.: 502,572

[22] Filed: Jul. 17, 1995

[51] Int. Cl.[6] ..... E06C 1/10

[52] U.S. Cl. ..... 182/93; 182/187

[58] Field of Search ..... 182/93, 116, 187, 182/188, 214, 107

[56] References Cited

U.S. PATENT DOCUMENTS

| | | | |
|---|---|---|---|
| 3,774,720 | 11/1973 | Hovey | 182/195 X |
| 4,592,446 | 6/1986 | White | 182/195 X |
| 5,143,177 | 9/1992 | Smith | 182/187 |
| 5,277,273 | 1/1994 | Grimes | 182/116 X |
| 5,509,499 | 4/1996 | Prejeen | 182/93 |

FOREIGN PATENT DOCUMENTS

| | | | |
|---|---|---|---|
| 9403693 | 2/1994 | WIPO | 182/93 |

OTHER PUBLICATIONS

"Speed Steps" flyer published by Alumitech Industries, Inc., Mamou, Louisiana.

*Primary Examiner*—Alvin C. Chin-Shue

*Attorney, Agent, or Firm*—Warner J. Delaune

[57] ABSTRACT

A modular ladder system for climbing trees is provided, comprising an upper assembly and a lower assembly, wherein the lower assembly is slidable relative to the upper assembly; wherein the upper assembly includes a first pair of support members attached to one another by a top step, and wherein the lower assembly includes a second pair of support members attached to one another by a bottom step; a locking device operatively disposed between the upper assembly and the lower assembly for selectively locking the position of the lower assembly relative to the upper assembly in an extended position and a retracted position; an attachment device on the upper assembly for attaching the ladder module to a tree; and a stabilizer on the upper assembly and the lower assembly for stabilizing the ladder module against the tree.

10 Claims, 9 Drawing Sheets

MODULAR LADDER SYSTEM

BACKGROUND OF THE INVENTION

I. Field of the Invention

The present invention relates generally to ladders, and more particularly to modular ladder systems for climbing trees.

II. Description of Prior Art

In the sport of hunting, especially when the quarry is deer, the use of a treestand is a very common practice. The treestand offers many advantages, such as enabling the hunter to view his surroundings from an elevated vantage point, and minimizing the chances of being spotted or smelled by the deer. Therefore, development of treestand technology to facilitate the achievement of these objectives has been quite progressive, focusing on both portability and adaptability. Despite the advances made in this filed, however, there still remains the problem of actually climbing the tree to set up the treestand, and a number of prior techniques have been attempted with varying levels of success. Several of these devices are explained below, and each one offers the hunter a unique balance of portability, strength, stability and adaptability to the tree-climbing environment.

The simplest ladder known in the prior art, other than simply using the branches of the tree, is the conventional ladder having two parallel members connected by perpendicular rungs. Whether such a ladder has a unitary construction or is a foldable extension ladder, it is extremely cumbersome for carrying through dense woods and is oftentimes quite heavy. Also, such ladders are necessarily straight, and they may not be well suited for use with a tree having an irregular shape. Finally, under the adverse conditions presented by most hunting environments, a conventional ladder is typically unstable and dangerous.

To overcome the problem of portability associated with conventional ladders, a number of alternative designs have been attempted. Some devices simply include two or more sections or modules of conventional ladder design which connect end-to-end, with the resulting assembly having one end resting on the ground and the other end (and/or mid-section) tied to the tree to improve stability. While these designs made headway in improving portability, they remain ill-suited for use with trees having an irregular vetical axis or many low branches which interfere with the long straight-line distance that the ladder is meant to span.

Another alternative design also comprises a number of connected modules, where each module has a single vertical member from which several steps are placed perpendicularly thereto. Some models have the steps offset from one another, such as in the case of the "Po-Jo Climbing Pole" manufactured by Amacker International, Inc., in Delhi, La. In other models, the steps are formed in a continuing T-configuration with respect to the vertical member, as seen in the "Sky Ladder" manufactured by Loc-On Company in Greensboro, N.C. The assembled ladder is then either tied to the tree with a rope or, or attached to the tree by a set of metal tongs. In those ladders where the steps are arranged in a continuing T-configuration, a purported advantage is that the climber is afforded the ability to place both feet on the same level while climbing, resulting in a more comfortable and stable climb.

Despite their apparent advantages, none of the above devices have addressed the problem of trees which have: (1) so-called "bell bottoms", or unusually wide trunks, such as cypress and tupelo trees typical in the southern United States; (2) a main vertical axis which is very irregular; or (3) many low-level branches which do not allow for a continuous ladder spanning a large distance to the treestand.

However, the ladder modules marketed under the trademark "Speed Steps" by Alumitech Industries, Inc., in Mamou, La., are an attempt to overcome those unique concerns. That ladder system is essentially a number of mini-ladders of conventional design which are separately attachable to the tree, except that the tips of the parallel rails at both ends are curved toward the tree to provide a four-point contact. While that device is an improvement over prior devices to some extent, the modules are not individually adjustable in any way, so they cannot make maximum use of the existing tree structure, and they cannot be made more compact for storage and transportation.

As a solution to most of the aforementioned problems, the inventor herein has previously developed a single-pole, modular ladder system, wherein each of the ladder modules is separately adjustable between a retracted position and an extended position, as disclosed in U.S. Ser. No. 08/214,835, scheduled to issue on Aug. 8, 1995. However, some hunters still prefer a double-rail type of ladder over a single-pole approach for safety reasons. For example, a double-rail design provides side-to-side protection against slippage from the ladder rungs, and it allows the hunter to grip the rails with both hands while climbing. What is now needed, therefore, is a double-rail, modular tree ladder system which is conveniently portable, strong, stable, and adaptable to a variety of tree climbing environments.

SUMMARY OF THE INVENTION

It is therefore an object of this invention to provide a portable tree ladder system which is strong, compact and lightweight.

It is also an object of this invention to provide a portable tree ladder system which is highly adaptable to the particular tree climbing situation.

It is a further object of this invention to provide a portable tree ladder system whose modules are adjustable in length.

Yet another object of this invention is to provide a portable tree ladder system which is safe and stable when used.

These and other objects and advantages of the present invention will no doubt become apparent to those skilled in the art after having read the following description of the preferred and alternate embodiments, which are contained in and illustrated by the various drawing figures.

Therefore, in a preferred embodiment, a modular ladder system for climbing trees is provided, comprising an upper assembly and a lower assembly, wherein said lower assembly is slidable relative to said upper assembly; wherein said upper assembly includes a first pair of support members attached to one another by a top step, and wherein said lower assembly includes a second pair of support members attached to one another by a bottom step; locking means operatively disposed between said upper assembly and said lower assembly for selectively locking the position of said lower assembly relative to said upper assembly in an extended position and a retracted position; means on said upper assembly for attaching said ladder module to a tree; and means on said upper assembly and said lower assembly for stabilizing said ladder module against said tree.

DETAILED DESCRIPTION OF THE INVENTION

Figure 1A:
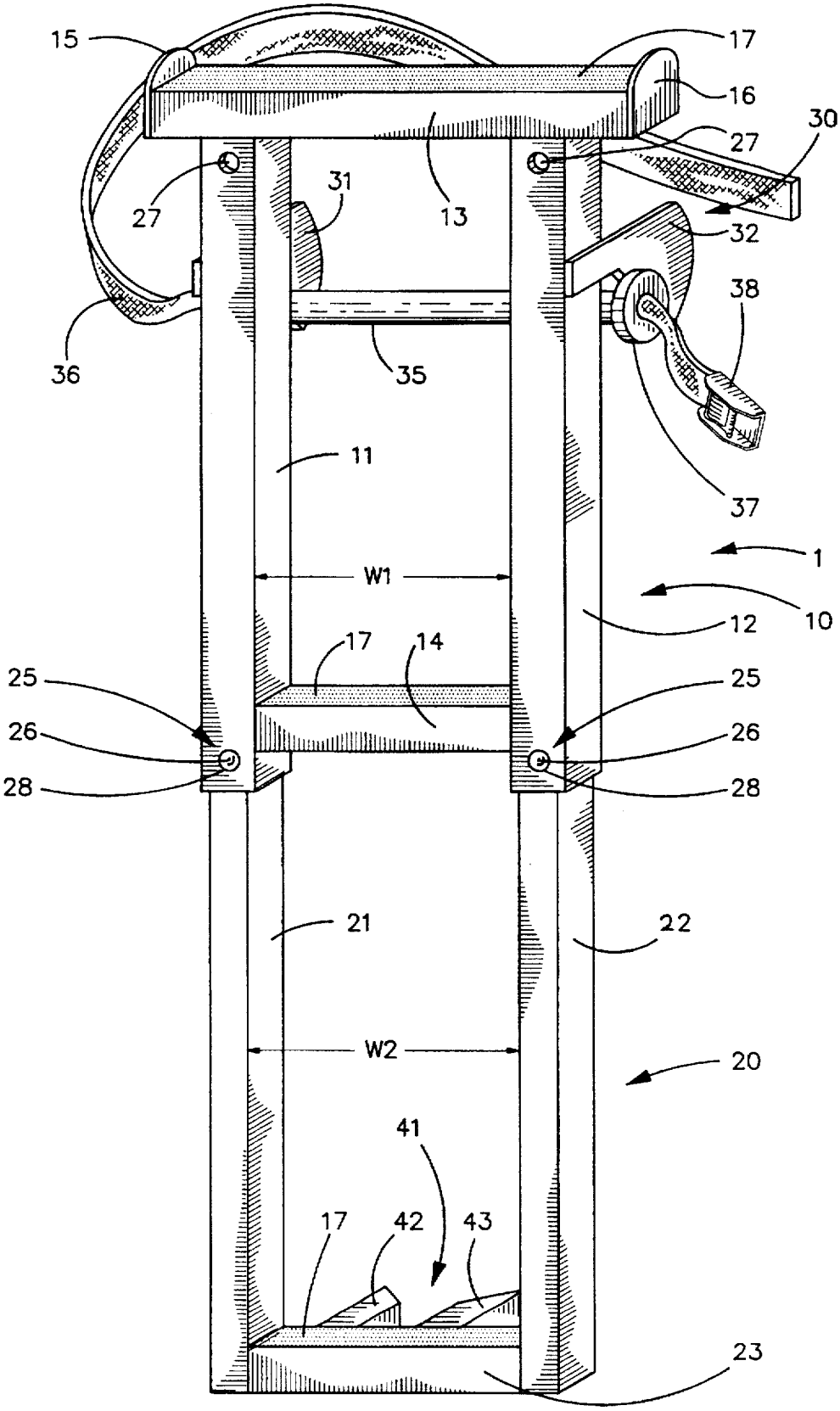
FIGS. 1A and 1B are perspective views of one embodiment of the invention in an extended position and a retracted position, respectively.

In the drawings many details pertaining to fabrication and maintenance utility well established in the machine construction an and not bearing upon points of novelty are omitted in the interest of descriptive clarity and efficiency. Such details may include threaded connections, lockrings, shear pins, weld lines and the like. Also, the spreading use of electron beam welding eliminates many such features and leaves no visible distinctive lines. Unless otherwise noted, all elements are preferably constructed from lightweight aluminum tubing, although a variety of other materials may also be used.

Figure 1B:
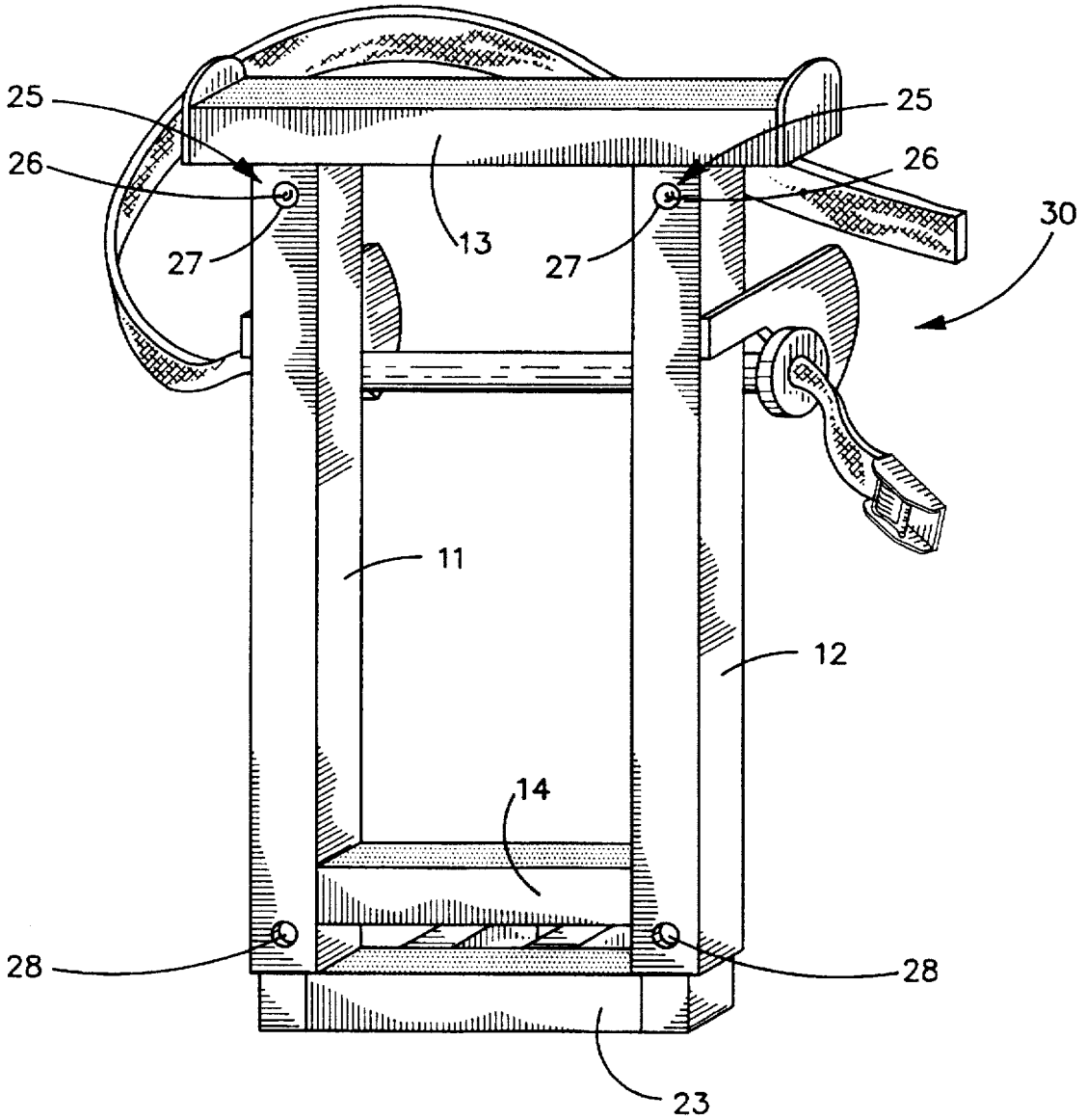

Turning now to FIG. 1A and 1B, one embodiment of the inventive tree ladder module 1 is shown which can be adjusted to suit the needs of the climber, generally comprising an upper assembly 10 and a lower assembly 20. Upper assembly 10 is comprised of parallel support members 11, 12 which are connected to one another by top step 13 and middle step 14, preferably by welding. Top step 13 and middle step 14 are attached substantially perpendicularly between parallel support members 11, 12, with top step 13 being located at the upper ends of parallel support members 11, 12 and middle step 14 being located near the lower ends of parallel support members 11, 12. Parallel support members 11, 12 are separated by a distance which is defined by the width W1 of middle step 14, which should be no wider than a single large shoe or boot. Less preferably, the width W1 of middle step 14 can also be made wide enough to accommodate both shoes, but at the sacrifice of some degree of portability. Top step 13, however, is preferably wide enough to accommodate both shoes so that a climber can stand comfortably with both feet at the same level.

For reasons of safety, top step 13 includes retaining tabs 15, 16 rigidly attached to the ends of top step 13, which help to prevent slippage of the climber's shoe from the ladder module 1 during climbing. As an added safety feature, top step 13 and middle step 14 should also include a non-slip, or abrasive, surface 17 for contact with the sole of the climber's shoe. Non-slip surface 17 can be added by any one of several methods widely known to those of ordinary skill, such as by an abrasive paint, an adhesive strip having embedded abrasive material, or by forming irregularities into steps 13, 14 during manufacturing.

Lower assembly 20 is comprised of a second pair of parallel support members 21, 22 which are connected to one another by bottom step 23, preferably by welding. Bottom step 23 is attached substantially perpendicularly between parallel support members 21, 22 and located at the lower ends of parallel support members 21, 22, as shown in FIG. 1A and 1B. Similar to the upper assembly 10, the parallel support members 21, 22 of the lower assembly 20 are separated by a distance which is defined by the width W2 of bottom step 23, which should be no wider than a single large shoe or boot. For the same reasons as in the upper assembly 10, the width W2 of bottom step 23 can be made wide enough to accommodate both shoes, but with some sacrifice in portability. Finally, bottom step 23 preferably includes a non-slip surface 17 of the type described previously herein.

Importantly, the width W2 between support members 21, 22 and the width W1 between support members 11, 12 are such that the support members 21, 22 of the lower assembly 20 are telescopingly slidable within the support members 11, 12 of upper assembly 10. Therefore, support members 21, 22 must have cross sectional shapes which will slide into and out of support members 11, 12. Preferably, there should be a relatively tight fit between upper assembly 10 and lower assembly 20, so that when the ladder module 1 is in an extended position, there will be little movement between upper assembly 10 and lower assembly 20.

In a retracted position as shown in FIG. 1B, lower assembly 20 is held almost entirely within upper assembly 10 by locking means 25. Locking means 25 can be any device on either upper assembly 10 or lower assembly 20 which effectively prevents lower assembly 20 from sliding out of upper assembly 10, such as a nut and bolt combination, or a spring loaded pin 26. If spring loaded pins 26 are employed, each of support members 11, 12 will include a first lock hole 27 near top step 13 and a second lock hole 28 near middle step 14. Spring loaded pins 26 are located on each of support members 21, 22 to engage either first lock holes 27 (thereby placing lower assembly 20 in a retracted position) or second lock holes 28 (thereby placing lower assembly 20 in an extended position, as shown in FIG. 1A). Of course, additional intermediate positions along the length of support members 11, 12 are possible by the formation of more lock holes, although the simple two-position design described above is sufficient for most purposes. To ensure stability, the relative locations of first and second lock holes 27,28 and spring loaded pins 26 should be such that at least two inches (2") of support members 21, 22 should remain within support members 11, 12 in an extended position.

In keeping with the goals of being lightweight and portable, the overall length of ladder module 1 is approximately three feet (3') in an extended position and approximately twenty-one inches (21") in a retracted position, which makes it quite easy to be carried during a hunting trip. Therefore, upper assembly 10 and lower assembly 20 should each be approximately twenty inches (20") in length, although the proportions between these two assemblies may vary somewhat without departing from the invention.

To ensure that the ladder module 1 is anchored firmly to the tree and to provide a means for spacing the ladder module 1 away from the tree to leave room for the climber's shoes, attachment means 30 is located on upper assembly 10. As shown in FIGS. 1A, 1B, 4A, and 4B, attachment means 30 comprises a pair of hook portions 31, 32 rigidly attached to and extending from the support members 11, 12 of upper assembly 10. Each of hook portions 31, 32 includes a front convex edge 33 for contacting a tree 40 and an inside inclined edge 34 for contacting a relatively stationary object as will be described shortly. The curvature of convex edge 33 is such that hook portions 31, 32 can be firmly seated against virtually any irregular surface of a tree 40, but while doing very little damage to the tree 40 during installation and use of ladder module 1. Hollow member 35 is a section of semi-rigid material, such as a durable plastic, and is longer than the distance between hook portions 31, 32 and is affixed to the tree 40 by strap 36, or any suitably strong flexible member, which is preferably threaded through hollow member 35. When installed, hollow member 35 serves to protect strap 36, although it may not be required if strap 36 is constructed of a suitably strong material, such as a metal cable. Strap 36 is attached to itself around the circumference of tree 40 by a self-tightening, quick release buckle 38. Hollow member 35 is also offset a short distance from tree 40 by a pair of spacers 37 located on 36. The inclined edges 34 of hook portions 31, 32 contact the hollow member 35 during installation and use, and they act as a wedge to firmly suspend ladder module 1 from strap 36. Thus, the greater weight that is placed on ladder module 1, the tighter the hold between hook portions 31, 32 and strap 36.

Stabilizing means 41 is also located on lower asssembly 20 to assist hook portions 31, 32 in keeping the climber's shoes away from the tree 40, and to lend stability to the lower end of ladder module 1. Stabilizing means 41 may simply comprise a pair of pointed tubing sections 42, 43 extending from the bottom step 23 (as shown in FIG. 1A) or from support members 21, 22. Providing at least four points of contact against the tree 40 (by tubing sections 42, 43 and hook portions 31, 32) prevents the ladder module 1 from moving relative to the tree 40 and creates a more stable structure.

Figure 2A:
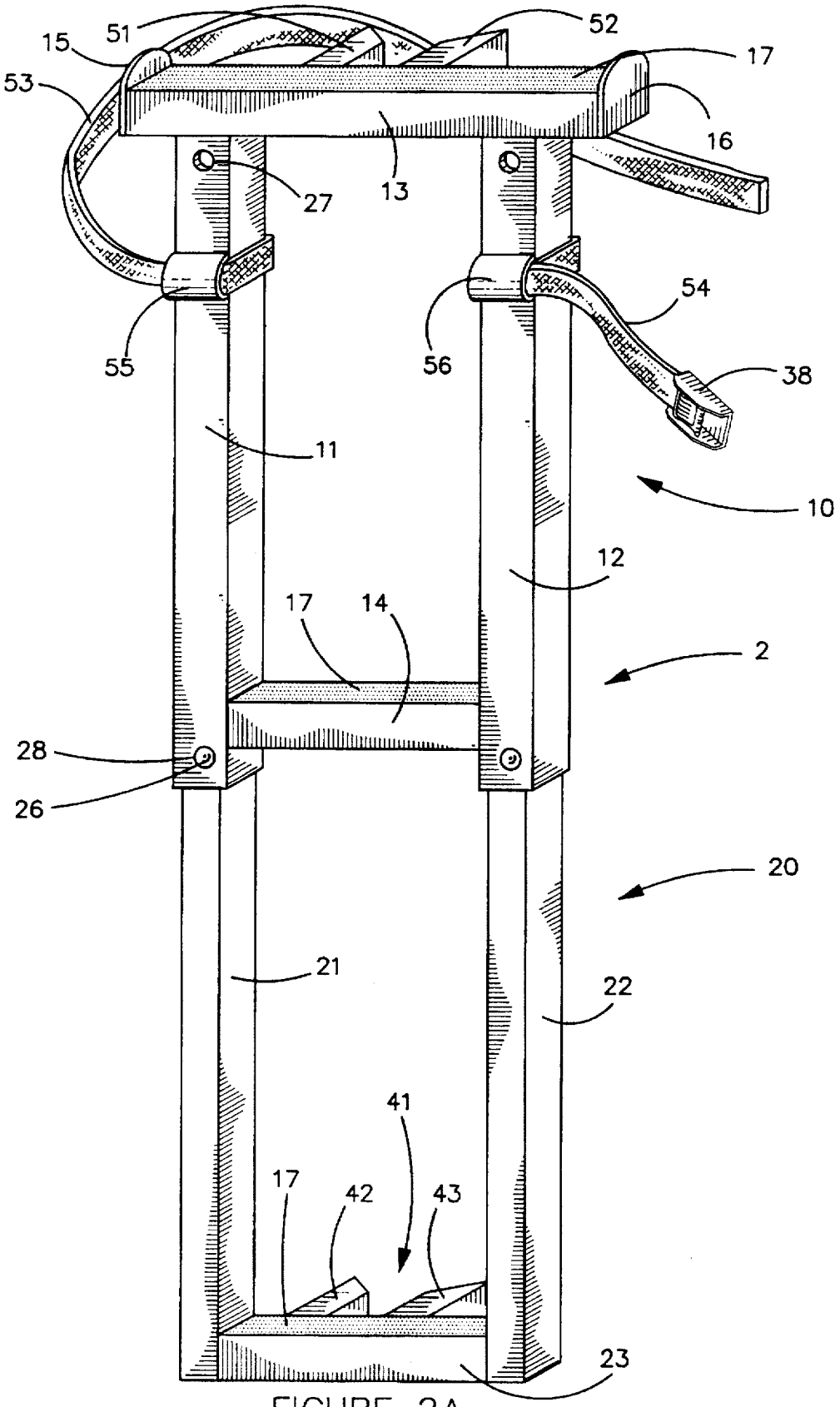
FIGS. 2A and 2B are perspective views of an alternative embodiment of the invention in an extended position and a retracted position, respectively.
Figure 2B:
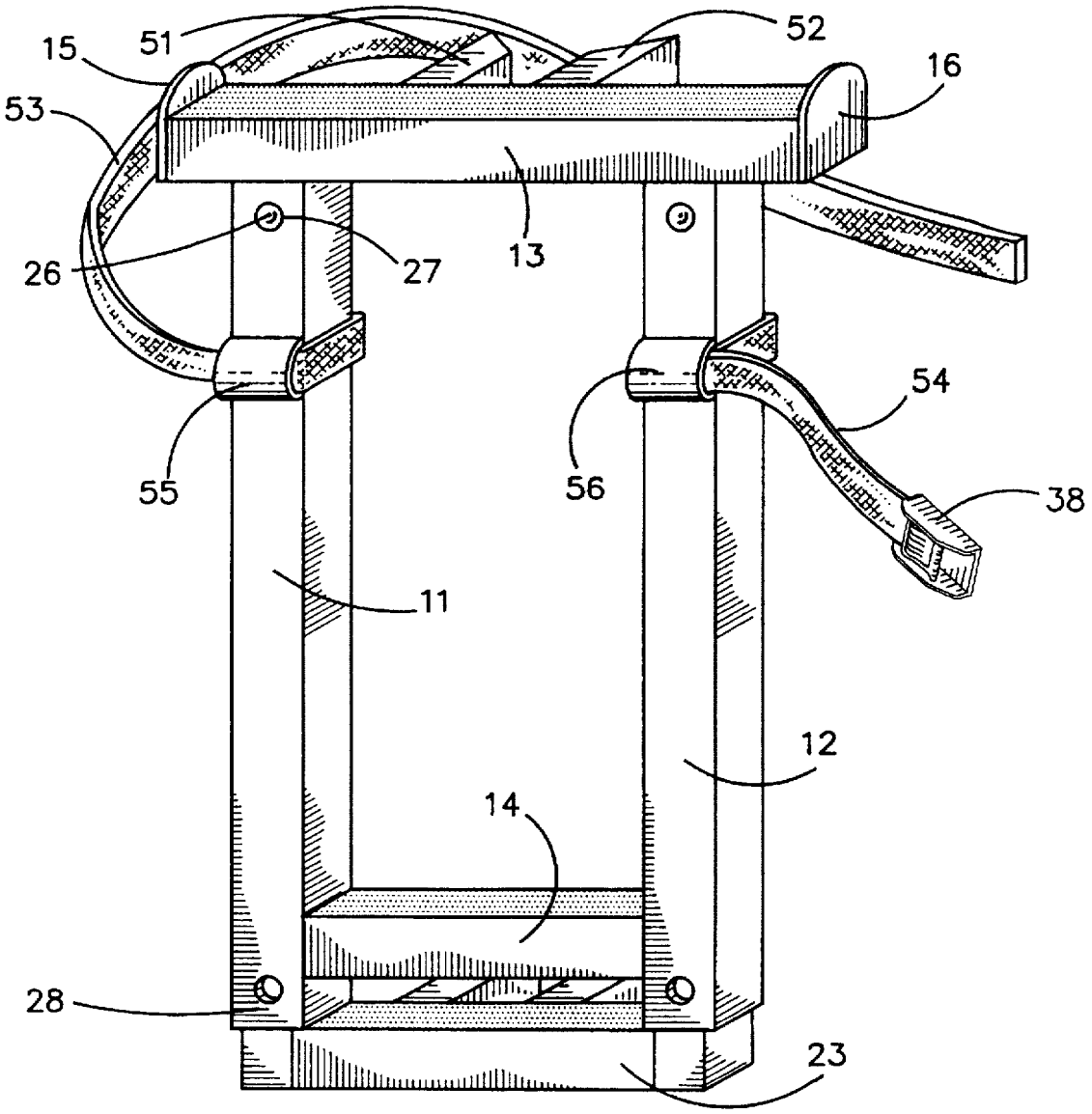

An alternative embodiment 2 of the invention is depicted in FIGS. 2A and 2B in an extended position and a retracted position, respectively. Ladder module 2 differs from the first embodiment 1 in the manner of its attachment to a tree 40. Rather than using the single strap 36 and hook portions 31, 32, ladder module 2 employs two strap sections 53, 54 and another pair of pointed tubing sections 51, 52 extending from top step 13 (as shown in FIG. 2A) or from support members 11, 12. Each of strap sections 53, 54 are tied, or otherwise strapped in any suitable manner, around its respective support member 11, 12 and through loops 55, 56 formed onto support members 11, 12, respectively. Loops 55, 56 are positioned between top step 13 and middle step 14 so that strap sections 53, 54 are not obstructed by top step 13 when the ladder module 2 sags under the weight of the climber. Quick release buckle 38 is attached to one end of either strap section 53 or 54 so that the strap sections 53, 54 can be securely joined around the circumference of the tree 40. As can be seen, this alternative embodiment also benefits from the four points of contact against the tree 40, and is somewhat simpler to attach to the tree 40 than the previous embodiment. It also allows the climber to place both shoes onto the double-width top step 13.

Figure 3A:
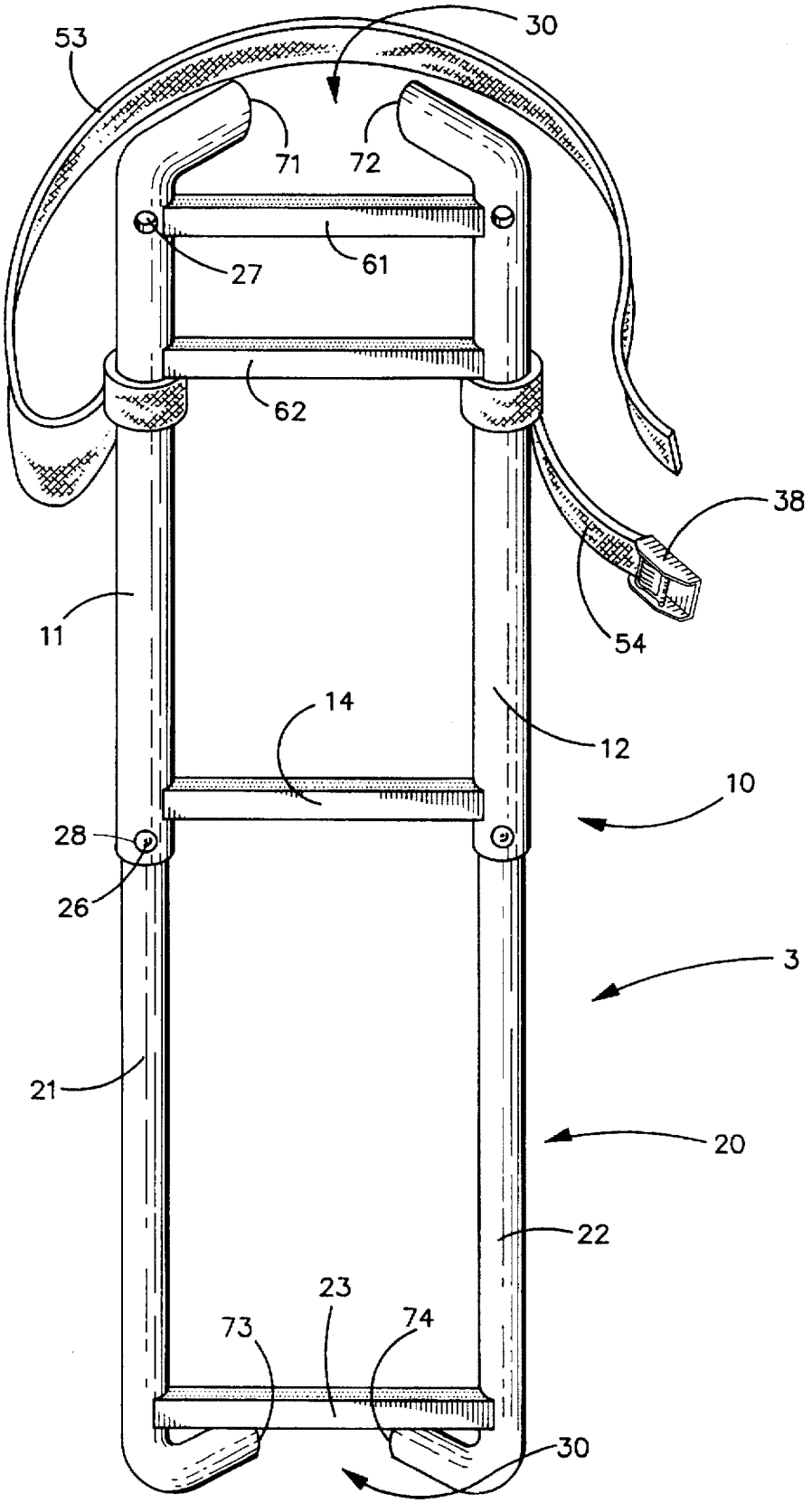
FIGS. 3A and 3B are perspective views of another alternative embodiment of the invention in an extended position and a retracted position, respectively.
Figure 3B:
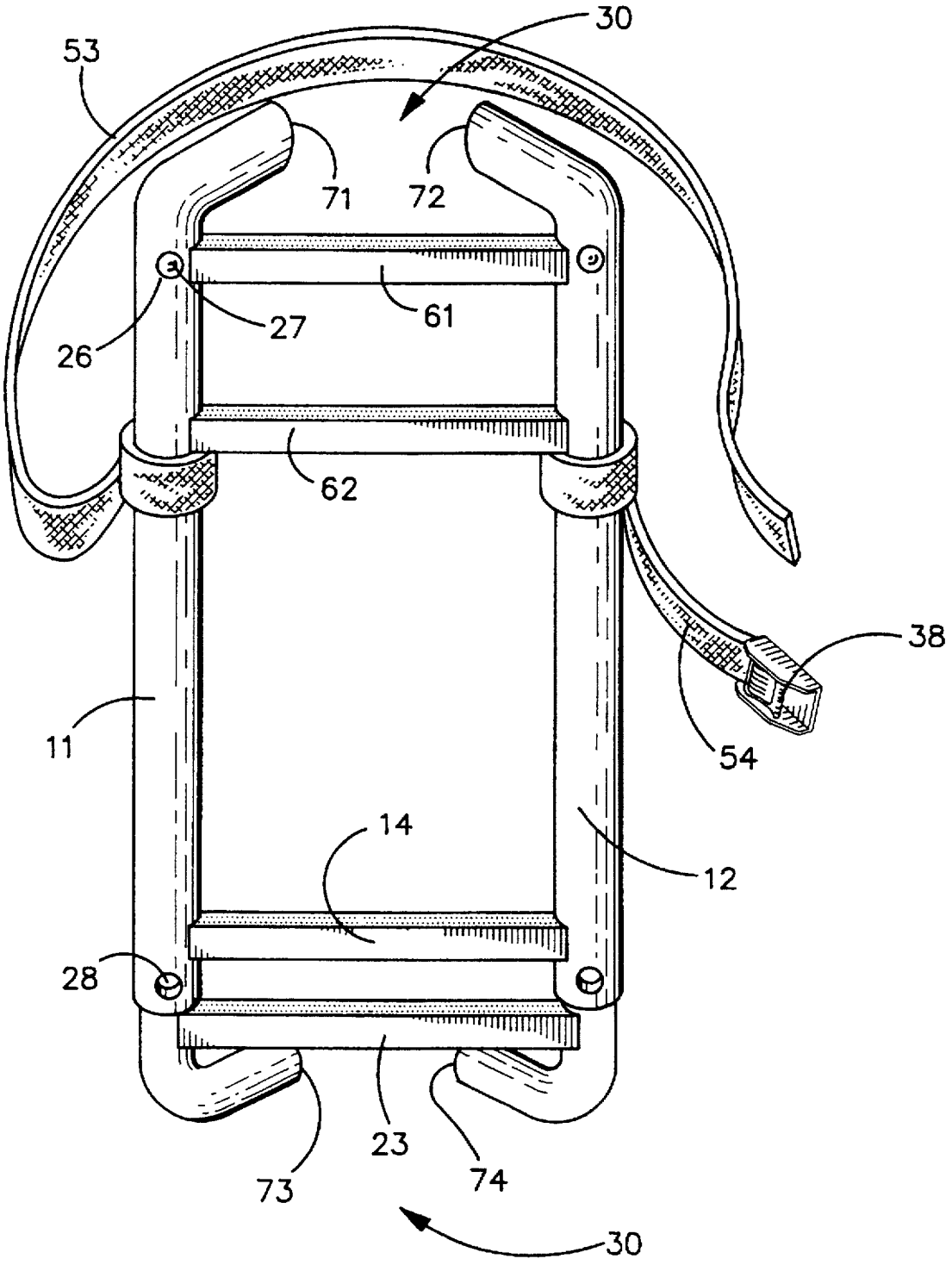
Figure 4A:
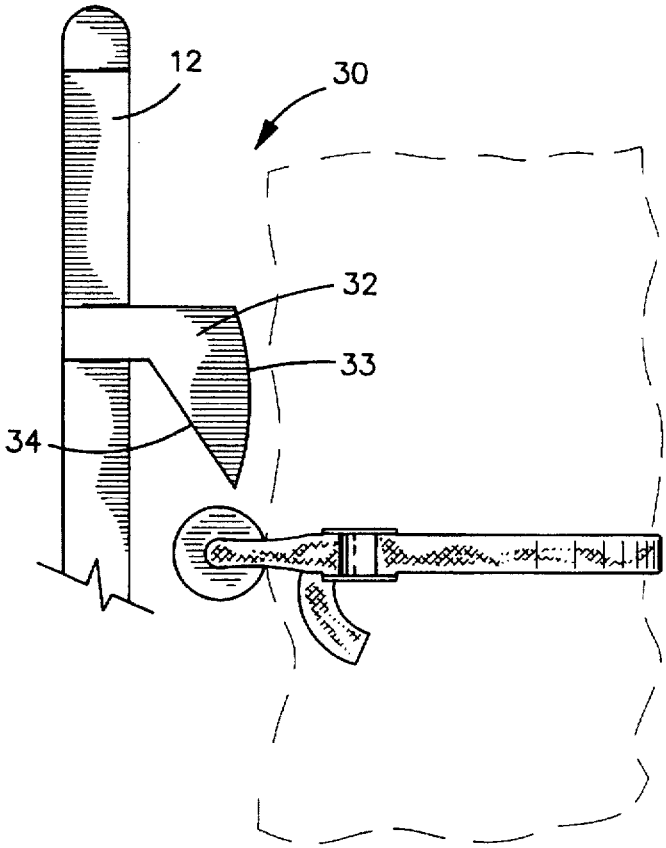
FIGS. 4A and 4B show the quick attachment feature which can be employed with any of the embodiments of the invention.
Figure 4B:
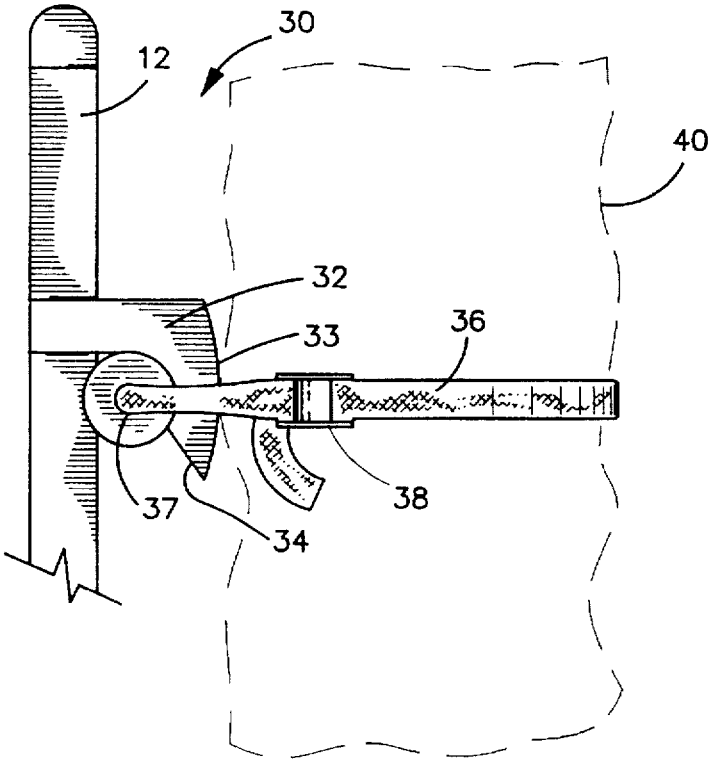

Another alternative embodiment 3 of the invention is shown in FIGS. 3A and 3B in an extended position and a retracted position, respectively. Ladder module 3, depicted as using round aluminum tubing, is similar to the previous embodiments 1, 2 in terms of adjustability, and employs essentially the same method of attachment to the tree 40 as the second embodiment 2. However, ladder module 3 differs from the previous embodiments 1, 2 in three key respects. First, the double-width top step 13 is replaced by two smaller steps 61, 62 placed one over the other. The distance between steps 61, 62 should be sufficient to allow passage of a large boot therebetween during climbing. This design requires the climber to place each foot on a separate step, but results in a thinner, more maneuverable ladder module. Second, the stabilizing means 30 is formed by bending the extreme ends 71, 72 of support members 11, 12 of upper assembly 10 and the extreme ends 73, 74 of support members 21, 22 of lower assembly 20 inward and toward the tree 40. Preferably, all four ends 71–74 are beveled to create a sharp or pointed area of contact with the tree 40. Finally, because of the presence of step 62, strap sections 53, 54 may be tied, or otherwise strapped in any suitable manner, to support members 11, 12 without the use of loops 55,56. As in the previous embodiment, quick release buckle 38 is attached to one end of either strap section 53 or 54 so that the strap sections 53, 54 can be securely joined around the circumference of the tree 40.

Figure 5A:
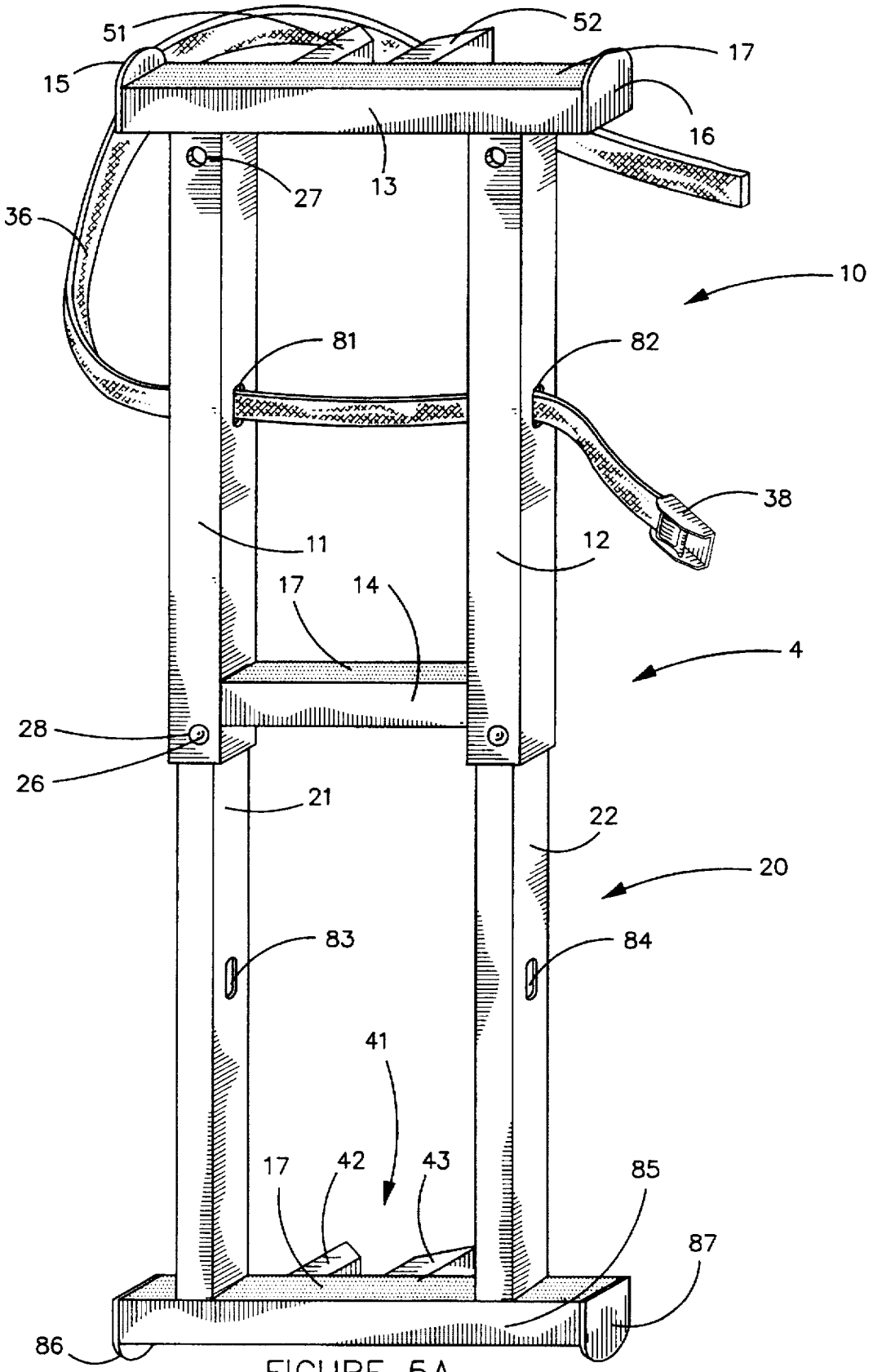
FIGS. 5A and 5B depict a preferred embodiment of the invention which can be used in either an upright or an inverted orientation.
Figure 5B:
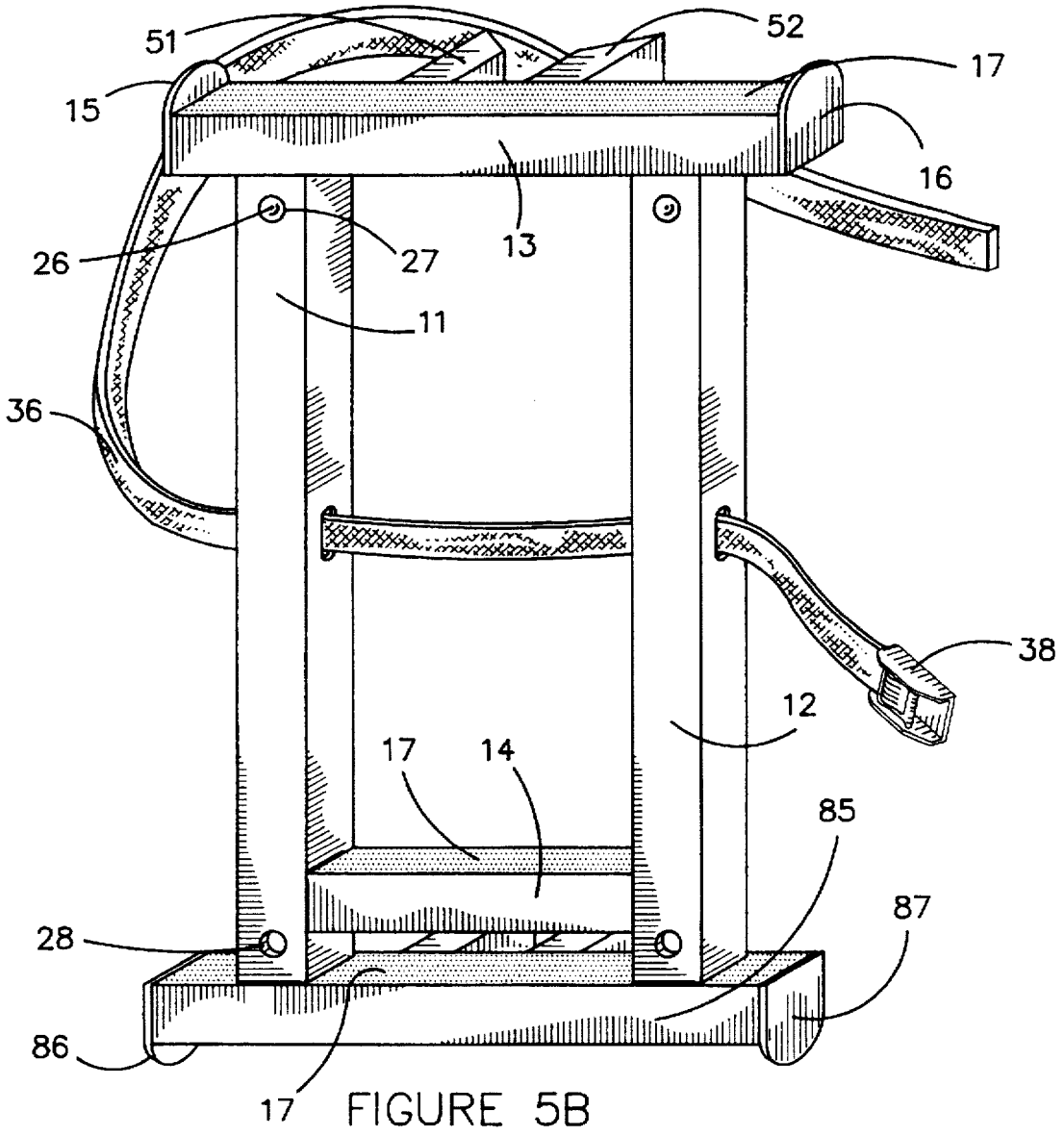

Finally, a preferred embodiment 4 of the invention is depicted in FIGS. 5A and 5B which can be used in either an upright or inverted orientation, as will be explained below. This embodiment is similar in many respects to the embodiment 2 of FIGS. 2A and 2B, and corresponding part numbers are used where applicable. Therefore, a description of the distinguishing features of the preferred embodiment 4 from the embodiment 2 of FIGS. 2A and 2B shall suffice. First, loops 55, 56 are replaced by upper slots 81, 82 formed completely through support members 11, 12. Upper slots 81, 82 are horizontally aligned with one another and are located at approximately the midpoint of the lengths of support members 11, 12. Thus, as can be seen in FIG. 5A, a single strap 36 (such as that shown in FIGS. 1A and 1B) may be passed through upper slots 81, 82 to secure the ladder module 4 in an extended position to a tree.

Additionally, lower slots 83, 84 are formed completely through support members 21, 22. Similar to upper slots 81, 82, lower slots 83, 84 are also horizontally aligned with one another and are located at approximately the midpoint of the lengths of support members 21, 22. Importantly, the precise location of upper slots 81, 82 and lower slots 83, 84 along their respective support members are such that lower slots 83, 84 become horizontally aligned with upper slots 81, 82 when lower assembly 20 is retracted and locked into upper assembly 10. Therefore, the ladder module 4 is easily securable to a tree by passing strap 36 through aligned slots 81–84 in a retracted position, as shown in FIG. 5B.

From the foregoing description, it can be seen that strap 36 may be passed only through lower slots 83, 84 if desired, so that ladder module 4 can be used with equal effectiveness in an extended position, but in an "inverted" (as opposed to an "upright") orientation. For the purposes of this description, "upright" is defined as an orientation of ladder module 4 wherein upper assembly 10 resides above lower assembly 20. Conversely, "inverted" is defined as an orientation of ladder module 4 wherein upper assembly 10 resides below lower assembly 20. Similarly, ladder module 4 can be secured to a tree in an inverted and retracted position for the same reasons explained above. Thus, the versatility of ladder module 4 is greater than that of the previously described embodiments.

Consistent with the ability of ladder module 4 to be used in an inverted position, the bottom step 23 of FIGS. 2A and 2B is replaced by a bottom step 85 identical to top step 13, although positioned so that retaining tabs 86, 87 are directed in an opposite direction from retaining tabs 15, 16. Likewise, the top and bottom surfaces of top step 13, middle step 14, and bottom step 85 include a non-slip surface 17, as previously described herein, so that a climber can have sure footing on ladder module 4 in either an upright or inverted position.

With reference to all three of the foregoing embodiments, it will be appreciated that the ability of the ladder module to retract and extend offers advantages to hunters for at least two important reasons. First, it is much easier to transport multiple ladder modules to and from a hunting site when the ladder modules are in a retracted position. Second, based on the particular branch structure of the tree to be climbed, the climber has the option of either extending or retracting the ladder modules of his choice to make maximum use of the tree branches and/or the ladder modules.

The overall concept of the foregoing embodiments of the invention is directed to providing a ladder system having a low-profile design for ease of carrying and storage. This design also helps the hunter in achieving a totally camouflaged appearance, because it is smaller and less bulky than competing designs. Furthermore, the adjustability enables the ladder modules to be placed within very tight spaces among tree limbs, contrary to other products seen in the prior art.

Although the present invention has been described in terms of specific embodiments, it is anticipated that alterations and modifications thereof will no doubt become apparent to those skilled in the art. For example, the above embodiments described and shown in the figures depict the lower assembly 20 as sliding within upper assembly 10. However, only slight modifications would be required to cause upper assembly 10 to slide within lower assembly 20, such as moving the middle step 14 to lower assembly 20 and changing the tubing cross section of support members 11, 12 to be smaller than that of support members 21, 22. It is therefore intended that the following claims be interpreted as covering all such alterations and modifications as fall within the true spirit and scope of the invention.

I claim:

1. A portable ladder module for climbing a tree, comprising:

(a) an upper assembly and a lower assembly, wherein said lower assembly is telescopingly slidable relative to said upper assembly;

wherein said upper assembly includes a first pair of support members attached to one another by a top step, wherein said top step is positioned an upper terminal end of said first pair of support members, and the ends of said top step extending laterally beyond said first pair of support members, and wherein said lower assembly includes a second pair of support members attached to one another by a bottom step;

(b) locking means operatively disposed between said upper assembly and said lower assembly for selectively locking the position of said lower assembly relative to said upper assembly in an extended position and a retracted position;

(c) means on said upper assembly for attaching said ladder module to a tree; and (d) means on said upper assembly and said lower assembly for stabilizing said ladder module against said tree.

2. The ladder module of claim 1, wherein said lower assembly is telescopingly slidable within said upper assembly, and wherein said upper assembly further includes a middle step attached between said first pair of support members.

3. The ladder module of claim 1, wherein said upper assembly is telescopingly slidable within said lower assembly, and wherein said lower assembly further includes a middle step attached between said second pair of support members.

4. The ladder module of claim 2, wherein said top step is wide enough to accommodate both shoes of a climber, and wherein said top step includes a retaining tab extending upward from each of the ends of said top step.

5. The ladder module of claim 2, wherein said top step, said middle step and said bottom step each include an upper non-slip surface.

6. The ladder module of claim 3, wherein said top step is wide enough to accommodate both shoes of a climber, and wherein said top step includes a retaining tab extending upward from each of the ends of said top step.

7. The ladder module of claim 3, wherein said top step, said middle step and said bottom step each include an upper non-slip surface.

8. The ladder module of claim 1, wherein said means for attaching said ladder module to said tree comprises:

(a) a pair of hook portions, wherein each of said hook portions includes a front convex edge and an inclined edge;

(b) a flexible member adapted to wrap around said tree; and (c) spacing means attached to said flexible member for maintaining a portion of said flexible member away from said tree sufficient to allow said hook portions to be placed between said flexible member and said tree.

9. The ladder module of claim 1, wherein said means for attaching said ladder module to said tree comprises a flexible member having a quick-release buckle.

10. The ladder module of claim 1, wherein said means for attaching said ladder module to said tree comprises:

(a) a first pair of slots formed through said first pair of support members;

(b) a second pair of slots formed through said second pair of support members; wherein said first pair of slots and said second pair of slots are alignable when said ladder module is in a retracted position; and (c) a flexible member adapted to pass through said first pair of slots or said second pair of slots.

* * * * *